United States Patent [19]

Perrine et al.

[11] 4,208,050

[45] Jun. 17, 1980

[54] JUMP MEASURING APPARATUS

[76] Inventors: James J. Perrine, 20412 Oxnard St., Woodland Hills, Calif. 91364; Allen E. Scates, 5314 Crebs Ave., Tarzana, Calif. 91356

[21] Appl. No.: 23,731

[22] Filed: Mar. 26, 1979

[51] Int. Cl.[2] ..... A63B 5/16; A63B 69/00

[52] U.S. Cl. ..... 273/1.5 A; 273/411; 272/100

[58] Field of Search ..... 273/1.5 R, 1.5 A, 102 AP, 273/95 R; 272/31 A, 100, 101

[56] References Cited

U.S. PATENT DOCUMENTS

| | | | |
|---|---|---|---|
| 2,469,145 | 5/1949 | Baliff | 273/1.5 A UX |
| 2,697,603 | 12/1954 | Haines | 273/1.5 A |
| 2,988,363 | 6/1961 | Hall | 273/102 AP X |
| 3,258,266 | 6/1966 | Kamish | 273/1.5 A |
| 3,272,507 | 9/1966 | Grau | 272/31 A |
| 3,534,956 | 10/1970 | Myers | 273/1.5 A |
| 3,795,396 | 3/1974 | Kropelnitski | 272/100 |

*Primary Examiner*—Paul E. Shapiro
*Attorney, Agent, or Firm*—Keith D. Beecher

[57] ABSTRACT

Apparatus is provided for measuring the ability of an athlete to jump vertically from a standing or running position. Such apparatus is useful, for example, in enabling coaches to determine the ability of athletes for such sports as basketball, volleyball, and even competitive swimming. The apparatus includes an upright frame which can be positioned away from any wall or other structure which could interfere with the use of the apparatus. A series of horizontally extending vanes are pivotally mounted one above the other in spaced parallel relationship at the upper end of the frame for individual angular movement about a vertical axis. The vanes are retained in their uniformly spaced and parallel relationship by, for example, a stack of precision spacers, or accurately spaced retaining rings, and axial-loading spring washers, or coil springs. The vanes are mounted so that they may pivot freely about the vertical axis on an individual basis, independent of all the other vanes. The vanes may be positioned at a predetermined height above the ground. To use the apparatus, the athlete makes successive jumps, either from a standing position or from a running position, each time trying to reach the highest reachable vane with his up-stretched hand. For each jump, the athlete taps the reachable vanes with his hand and displaces them angularly around the vertical axis, leaving only the vanes he could not reach in their original angular position. In successive jumps, the athlete tries to reach higher and higher vanes.

8 Claims, 6 Drawing Figures

20A
20
22
24
24A
26
28
30
32
50
52
54
6
10
12
16
18

JUMP MEASURING APPARATUS

BACKGROUND

Prior to the present invention, vertical jumping potential typically was measured by having an athlete jump and, with his hand, place a chalk or similar mark as high as possible on a wall or stand-mounted blackboard, or equivalent. While such prior art equipment has the virtue of being very simple and inexpensive, it requires the athlete to execute an approach or jumping motion different from the actual jumping movements which are intrinsic to sports such as basketball and volleyball. Moreover, such equipment is virtually limited to standing jumps, rather than to any typical running jumps, because the wall or blackboard constitutes an obstruction. In addition, once the athlete has placed an initial mark on the board, there is no specific, higher visual target-height on such prior art equipment that the athlete could strive to reach. As a result, the prior art methods of vertical jump testing using the equipment mentioned above has been of limited usefulness in sports programs, and has had even less application as a vertical jump training means.

Other types of jump measuring instruments and apparatus are known to the art, as, for example, the devices described in U.S. Pat. Nos. 3,258,266; 3,795,396; 3,534,956 and 3,050,305. However, such devices are complicated in their construction, and are incapable of achieving the objectives of the apparatus of the present invention, as will be described.

Specifically, none of the patents listed above, discloses the type of apparatus of the present invention in which a series of horizontal vanes are supported as a vertical array in spaced and parallel relationship, with each of the vanes being capable of being moved around a vertical axis from a first to a second angular position as the athlete jumps and taps the vanes with his outstretched hand.

A jump measuring apparatus of the same general type as the apparatus of the invention is illustrated in the Volleyball Technical Journal of the Canadian Volleyball Association for Spring 1976. The apparatus illustrated in the publication comprises a series of horizontal keys positioned one above the other, and the athlete jumps and touches the highest possible key. However, there is no showing or description in the publication of the specific apparatus of the present invention in which a vertical stack of spaced and parallel horizontal vanes are mounted for individual rotation about a vertical axis, and with the vanes being axially loaded so that they can have more useful substantial length without any tendency to sage, and also to allow for momentary upward or downward deflections of the vanes upon impact to dissipate shock and avoid breakage.

Consequently, the principal objective of the present invention is to provide an improved vertical jump measuring apparatus which measures vertical jumps of an athlete without impeding the athlete in any way, and thus allows the athlete to practice maximum standing or running jumps using his normal jumping motion/technique, or one that his coach, for example, might prefer. Another objective of the invention is to provide an improved vertical jump measuring apparatus which provides specific, graduated, height targets to challenge and guide individuals into obtaining their maximum possible jump height.

Yet another objective of the invention is to provide an improved vertical jump measuring apparatus which is sufficiently precise and sensitive so as to be able to detect small differences or changes in jump performance, for example, of the order of one inch, or one centimeter, yet which is designed and constructed so that it can withstand vigorous daily usage and yet maintain its basic operating integrity and accuracy for a reasonable period of time.

The vertical jump measuring apparatus of the invention is both useful and versatile, and serves equally well for fulfilling the vertical jump testing and training needs of school basketball and volleyball programs; administering valid screening tests for natural leg power, and thus for general athletic potential among prospective athletes in many sports; providing a natural and functional index of muscle capacity and fitness for participants in physical education and adult fitness classes; and implementing physical education, laboratory exercises, research, and the like.

DETAILED DESCRIPTION

Figures 1, 2, 3, 4, 5, 6:
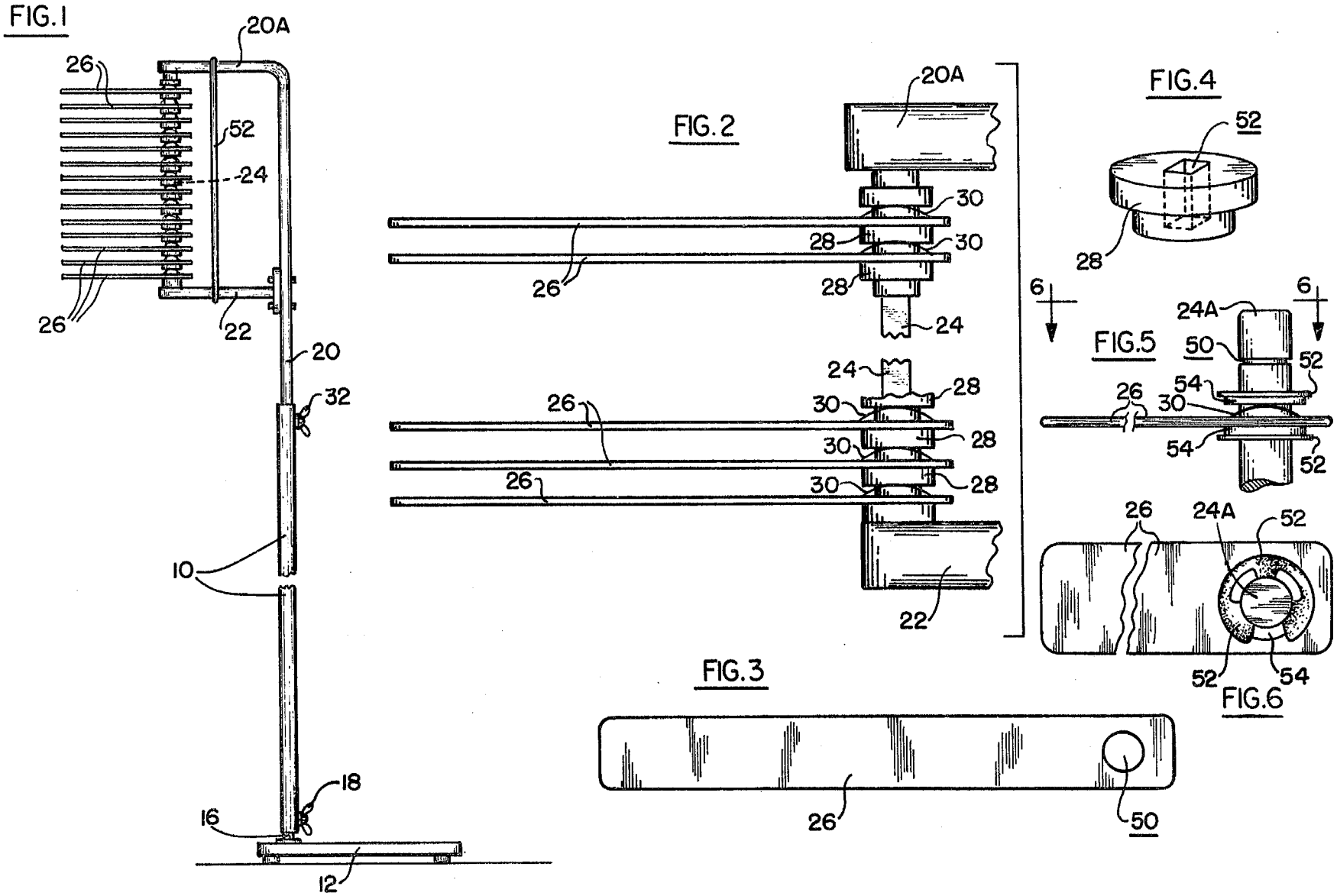
FIG. 1 is a side elevation of one embodiment of the invention.
FIG. 2 is an enlarged view of a vane assembly which is included in the apparatus of FIG. 1.
FIG. 3 is a plan view of one of the vanes included in the assemblies of FIGS. 1 and 2.
FIG. 4 is a perspective view of a spacer which is interposed between each pair of the vanes in the assembly.
FIG. 5 is a side elevation of a second embodiment.
FIG. 6 is a top plan view of the second embodiment, taken along the lines 6—6 of FIG. 5.

The apparatus of the invention includes a head frame assembly and a floor stand or wall mounting assembly. In the illustrated embodiment, the apparatus is shown as including a floor stand which cmprises a first upright tubular member 10, which is supported in its upright position on a horizontal base 12. Tubular member 10 may be removably secured to an upright stud 16 on the base and held in place, for example, by a set screw 18, so that the stand may be demountable.

The apparatus also includes a head assembly comprising a second upright tubular member 20 which is telescopically received in the first tubular member 10, and which can be adjusted to any desired height and held in place, for example, by a set screw 22. The top end 20A of tubular member 20 is bent over into a horizontal position, and a horizontal bracket 22 is mounted on the tubular member 20 in spaced parallel relationship to the end portion 20A.

A vertical shaft 24, preferably having a square cross-section, is mounted between the top end portion 20A and of tubular member 20 and bracket 22. A plurality of vanes 26 are mounted in spaced and parallel relationship on the vertical shaft 24, with the vanes extending horizontally outwardly from the shaft. The vanes are mounted on shaft 24 as shown in FIG. 2, with each pair of vanes being separated by a spacer 28 (FIG. 4) and axially loaded by a bowed spring washer 30. Each vane may have the configuration as shown in FIG. 3, for example, and may have a length of the order of 9 inches and width of the order of 1.25 inches.

Uniform vertical spacing of the vanes along the vertical axis of the square shaft 24 is maintained by the precision spacers 28. In addition, the spring washers 20 gently and continuously press each vane against the adjacent spacer. This eliminates any sag of the vanes, and serves to keep the vanes parallel and uniformly spaced in their horizontal position, thereby permitting the use of adequately long vanes so as to achieve the intended purpose of the apparatus. The spacers 28 and resilient washers 20 allow the vanes both to be pivoted freely about the vertical axis of the shaft 24 on an individual basis, as they are tapped by the athlete, and also momentarily to be deflected upwardly or downwardly under impact so as to avoid breakage. To this end, the axis hole 50 in each vane may be made somewhat oversized to permit the upwardly and downward deflection movements. The vanes can be color coded to help the athletes to see the full and half-inch increments, every 6th inch, etc.

When the apparatus is in use, the head frame is positioned on the floor stand at a selected height, so that the bottom vane is a known distance above the floor. This is achieved by loosening the set screw 22, and by sliding the tubular member 20 up and down within the tubular member 10, and then by tightening the screw 22.

The athlete then makes a preliminary jump and taps the highest reachable vane with his upstretched hand. When that occurs, the highest reachable vane, together with all the vanes below it, are displaced angularly about the vertical axis of the shaft until restrained by an elastic cord 52 which extends between the bentover top end 20 and the bracket 22. In a series of successive jumps, using the most advantageous or instructed jumping motion technique, the athlete then seeks to touch higher and higher vanes until his effective current vertical jump limit is reached. This process can be repeated after a short rest for training purposes, or at a later date to measure jump potential after some period of time, other training activities, etc.

The vanes 26 may conveniently be made of a suitable plastic material such as acrylic. The spacers 28 may, likewise, be made out of an appropriate material such as Delrin.

In the embodiment of FIGS. 5 and 6, the vanes 26 are supported on a shaft 24A which may have a circular cross-section, and which has a series of precisely spaced peripheral grooves 50 along its length. A corresponding plurality of retaining rings 52 are snapped into the respective grooves, and the retaining rings support bowed spring washers 30, and if desired, washers 54 which, in turn support the vanes 26, as shown in FIG. 5. The bowed spring washers 30 may be replaced by soil springs in either embodiment.

The invention provides, therefore, a rugged, sturdy and inexpensive apparatus for measuring the ability of an athlete to jump vertically from either a standing or running position, without in any way impending the natural technique of the athlete.

It will be appreciated that although particular embodiments of the invention have been illustrated and described, modifications may be made. It is intended in the following claims to cover all modifications which come within the spirit and scope of the invention.

What is claimed is:

1. Apparatus for measuring the ability of an athlete to jump vertically from a running or standing position, and which includes: a head frame; means for supporting the head frame a predetermined distance above the running or standing surface; a vertical shaft mounted on said head frame; a plurality of horizontally extending vanes mounted in spaced and parallel relationship along the vertical shaft; a plurality of spacing members mounted on said vertical shaft between successive pairs of the vanes; and resilient means for axially loading each vane against an adjacent one of the spacing members.

2. The apparatus defined in claim 1, in which said supporting means includes a base and a first upright elongated member mounted on said base, and in which said head frame includes a second upright elongated member telescopically received by said first elongated member, and set screw means for retaining the second elongated member at any selected height.

3. The apparatus defined in claim 1, in which said vertical shaft has a selected cross-sectional shape, and said spacing members comprise spacers having bores with a shape corresponding to the cross-sectional shape of said shaft to be supported on said shaft and restrained thereon from rotational movement with respect thereto.

4. The apparatus defined in claim 1, in which said spacing members are retaining rings received in peripheral grooves in said shaft and positioned therealong at predetermined spaced axial locations.

5. The apparatus defined in claim 1, in which said resilient axial loading means comprises a plurality of bowed spring washers mounted on said shaft.

6. The apparatus defined in claim 1, and which includes a resilient cord mounted on said head frame in a vertical position spaced from said vertical shaft to restrain the angular movement of the vanes about the vertical axis of the shaft.

7. The apparatus defined in claim 1, in which the vanes are formed of a selected plastic material.

8. The apparatus defined in claim 1, in which the spacers are formed of a selected plastic material.

* * * * *